United States Patent [19]

Lin

[11] Patent Number: 4,794,984

[45] Date of Patent: Jan. 3, 1989

[54] ARRANGEMENT FOR INCREASING HEAT TRANSFER COEFFICIENT BETWEEN A HEATING SURFACE AND A BOILING LIQUID

[76] Inventor: Pang-Yien Lin, No. 16-4, Fu-Ho St., Taichung City, Taiwan

[21] Appl. No.: 116,974

[22] Filed: Nov. 5, 1987

Related U.S. Application Data

[63] Continuation-in-part of Ser. No. 932,522, Nov. 10, 1986, abandoned.

[51] Int. Cl.[4] ..... F28F 13/18

[52] U.S. Cl. ..... 165/133; 165/911; 62/527

[58] Field of Search ..... 165/133, 911; 62/527

[56] References Cited

U.S. PATENT DOCUMENTS

| | | | |
|---|---|---|---|
| 4,434,842 | 3/1984 | Gregory | 165/133 |
| 4,561,497 | 12/1985 | Nakasima et al. | 165/133 |
| 4,602,681 | 7/1986 | Daikoku et al. | 165/133 |
| 4,606,405 | 8/1986 | Hakayama et al. | 165/133 |
| 4,619,316 | 10/1986 | Nakayama et al. | 165/133 X |
| 4,653,163 | 3/1987 | Kuwahaza et al. | 165/133 X |

FOREIGN PATENT DOCUMENTS

| | | | |
|---|---|---|---|
| 52-11464 | 1/1977 | Japan | 165/133 |
| 58-120086 | 7/1983 | Japan | 165/133 |
| 59-46490 | 3/1984 | Japan | 165/133 |
| 59-93192 | 5/1984 | Japan | 165/133 |
| 59-84095 | 5/1984 | Japan | 165/133 |
| 59-93181 | 5/1984 | Japan | 165/133 |

*Primary Examiner*—Ira S. Lazarus
*Assistant Examiner*—Richard R. Cole
*Attorney, Agent, or Firm*—Cushman, Darby & Cushman

[57] ABSTRACT

A single layer cover means is disposed over and spaced apart from a heating surface for diverting vapor to flow along the heating surface, the cover means having openings to permit vapor to flow therethrough, the openings having an effective diameter equal to or greater than the distance between the heating surface and the cover means. The cover means induces an agitiating effect across the heating surface to enhance the heat transfer performance instead of forming nucleation sites. A plurality of spacer members is disposed at intervals between the heating surface and the cover means.

29 Claims, 10 Drawing Sheets

ARRANGEMENT FOR INCREASING HEAT TRANSFER COEFFICIENT BETWEEN A HEATING SURFACE AND A BOILING LIQUID

This application is a continuation-in-part application of U.S. patent application Ser. No. 932,522 filed on Nov. 10, 1986 which is abandoned.

BACKGROUND OF THE INVENTION

This invention relates to a heat transfer surface for generating vapor from liquid, and particularly to a heat transfer surface having a single layer cover means disposed over a heating surface for diverting the vapor generated to flow along the heating surface and having openings for releasing freely the vapor out of the cover means.

Various heat transfer surfaces for enhancing nucleate boiling have been suggested in the art. There is a general concept in nucleate boiling that the heat transfer performance of a heat transfer surface can be enhanced by increasing nucleation sites on the heating surfaces or by inducing agitation near the heat transfer surface. Most of the heat transfer surfaces in the art relate to the type which produce nucleation sites such as small voids or cavities under a heating surface. Most vapor bubbles are generated in these voids or cavities. Restricted openings are provided for releasing the vapor generated in the cavities and for the entering of the liquid into the cavities. Such kinds of nucleation sites are vapor traps which trap the vapor generated. Only when the vapor pressure in the cavities increases to be greater than that of the liquid outside the cavities, do the vapor bubbles depart from the cavities. Examples of the references which disclose such heat transfer surfaces are U.S. Pat. Nos. 4,561,497, 4,606,405, 4,619,316 and 4,602,681 and Japanese Pat. No. 59-46490.

The heat transfer surface disclosed in U.S. Pat. No. 4,561,497 includes a plurality of rows of parallel void strip members between a base member and an outer surface region and restricted openings at both ends of each void strip member. The void strip members are formed by one or more layers of grooved thin plates laminated with the heating surface. The grooved thin plates must be bonded intimately to the heating surface, preferably with a metallurgical bond, to form the void strip members. The void strip members are intercommunicated through communication portions adjacent to the restricted openings so that vapor bubbles and vapor films are easily formed in the void strip members. The openings in the apparatus of this patent are formed by spacing the thin plate members and are restricted so that vapor can be released from the void strip members when the vapor pressure increases.

The heat transfer surface disclosed in U.S. Pat. No. 4,606,405 is also provided with narrow voids and restricted openings. The cross-sectional area of each void is greater than that of the restricted opening. The heat transfer surface disclosed in U.S. Pat. No. 4,619,316 is characterized in that, a heat conductive member which is installed on a heat generating body and has a plurality of layers of conductive plates which have narrow long cavity groups and apertures are stacked in a direction perpendicular to the surface of the heat generating body. The conductive plates include alternately stacked vertical cavity groups and horizontal cavity groups. Besides the above described differences of the arrangement from the present invention, the size of the apertures is small relative to the dimension of the cavity, and hence the vapour bubbles are restricted from flowing freely out of the cavities which perform the function of nucleation sites.

The heat transfer surface described in U.S. Pat. No. 4,602,681 also has a plurality of cells and restricted holes, and the cells are formed in a plurality of laminated layers in a direction from an outer surface of the heat transfer wall to an inside thereof.

Japanese Pat. No. 59-46490 discloses a heat transfer wall having primary cavity parts and primary openings in a lower layer and a secondary cavity parts in an upper layer. The upper layer which is formed by depressing the tops of the fins is employed for confining small cavities which are vapor bubble producing points or nucleation sites.

Generally, the fabrication of the heat transfer surfaces described above is complicated since particular configurations of narrow long cavities and restricted openings are necessary so as to achieve a desired effect. Furthermore, the parts for confining cavities must be formed as one piece with the heating surface or bonded intimately to the heating surface, thereby causing complication in the processing of the heat transfer surface. The quantities of the cavities are numerous and the density of the restricted openings on the heating surface should be very high. In addition, these cavities are liable to be clogged with impurities.

SUMMARY OF THE INVENTION

An object of the invention is to provide an arrangement for the transfer of heat in nucleate boiling which improves a heat transfer performance of a heating surface by causing turbulences near the heating surface with the natural power of the upwardly moving vapor bubbles along the heating surface so as to agitate liquid and vapor.

Another object of the invention is to provide an arrangement for the transfer of heat in nucleate boiling which can be fabricated more easily than the prior heat transfer surfaces.

The present invention provides an arrangement for transferring heat in nucleate boiling which comprises a heat transfer surface, a single layer cover means disposed over the heat transfer surface for diverting vapor to flow along the heating surface, and a plurality of spacer members disposed at intervals between the heating surface and the cover means.

The cover means the present invention is a single layer and is separate from the heating surface. The cover means diverts the generated vapor bubbles to flow along the heating surface for some distance. Openings are provided in the cover means for permitting liquid and vapor to flow freely therethrough without restriction. The distance between the heating surface and the cover means and the dimension of the openings are arranged in such a manner that the "effective diameter" of the opening is greater than the distance between the heating surface and the cover means so that the vapor generated in the space between the cover means and the heating surface can flow freely out from the space without restriction. The term "effective diameter of the opening" used herein would be defined by the diameter of a largest ball which can be fitted within the opening. The relation between the "effective diameter" of the opening and the distance between the heating surface and the cover means can also be expressed by:

$d > \sqrt{s \cdot L}$ where d is the effective diameter of the opening, s is the distance between the heating surface and the cover means, and L is the horizontal distance between the centers of two adjacent openings.

The ends of the spacer members which are disposed between the cover means and the heating surface need not contact intimately with the opposite surface. No tiny cavity is made under the heating surface to produce nucleation sites. The openings on the cover means are different from the restricted openings which are rather smaller than the size of the cavities. The density of the openings need not be so high as those of the prior art. Since the cover means is not a part of the heating surface, it can be made from either a metal or a non-metallic material. Since no particular shape of cavity formation is necessary in the heating surface of the invention, the cover means of the invention can be fabricated easily. The spacer members may be of any shape either regular or irregular and can be disposed either regularly or irregularly on the heating surface. The cover means and the spacer members need not to be bonded intimately to the heating surface and thus, the care required to ensure that all of the spacer members be bonded to or be in contact with the heating surface becomes unnecessary. Any spacer members which can make passages of suitable dimension between the cover means and the heating surface can be employed in the present invention.

In constract with the above-mentioned prior heat transfer surfaces, the cover means of the invention does not form cavities and restricted openings which perform the function of nucleation sites but enhances the agitating action of liquid and vapor at the heating surface by using the natural power of the upwardly moving vapor bubbles along the heating surface, thereby increasing the heat transfer efficiency between the heating surface and the liquid. Moreover, the present invention can alleviate the problem of the clogging of nucleation sites with impurities which occurs in the prior heat transfer surfaces.

DETAILED DESCRIPTION OF THE PREFERRED EMBODIMENTS

Figure 1:
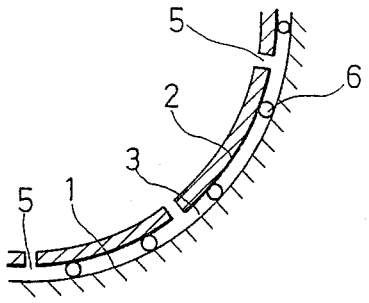
FIGS. 1 to 5 show different heat transfer arrangement according to the present invention.
Figure 2:
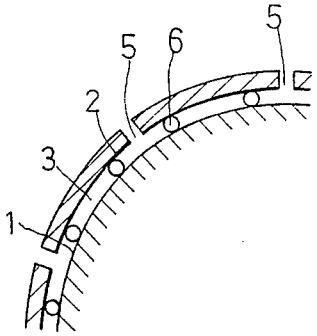
Figure 3:
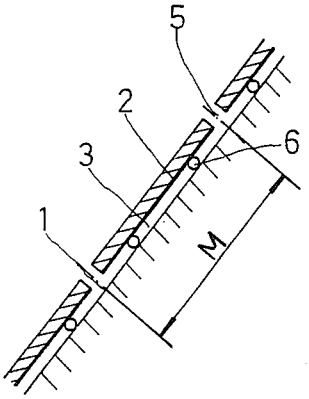
Figure 4:
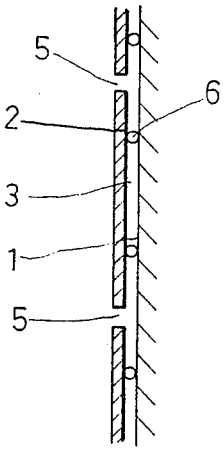
Figure 5:
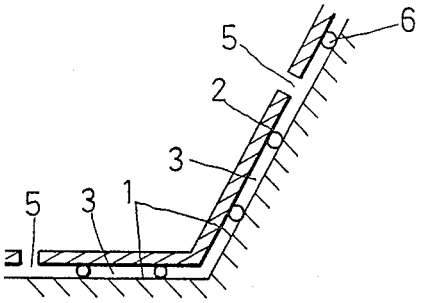

Referring to FIGS. 1, 2, 3, 4 and 5, heat transfer enhancing arrangements according to the present invention are shown, including a heating surface 1 and a cover means 2. The heating surfaces 1 as shown are the surfaces of concave, convex, inclined and vertical walls. The cover means 2 is disposed in a liquid to be boiled and has a surface spaced apart from the heating surface 1, forming a space 3 therebetween for the passage of the liquid and the vapor generated. Openings 5 are disposed at intervals in the cover means 2. The cover means 2 diverts vapor bubbles to flow upward across the heating surface 1 and then release them without restriction from the space 3 through the openings 5 and also permits the liquid to flow freely into the space 3. Although the cover means 2 as shown is a plate-shape, it is not limited thereto. It can be of any shape that has a surface extending adjacent the heating surface 1 to form the space 3 therebetween. In order to space the cover means 2 from the heating surface 1, spacer members 6 are disposed between the heating surface 1 and the cover means 2. The spacer members 6 may be in various forms. The details of the spacer members 6 will be described hereinafter.

The space between the cover means 2 and the heating surface 1 can be varied according to the heat flux across the heating surface. Preferably, the space is 0.05 mm to 10 mm, and more preferably 0.1 mm to 5 mm. The cover means 2 may be an impervious material or a pervious material preferably with pores not greater than 1.0 mm, and may be a one-piece cover member or has a plurality of separate cover members. When the latter one is used, the width of each cover member may not be smaller than 4 mm. The pervious material may be the screen netted from wires, perforated plates, plates with cracks or fabrics, etc. In case of separate cover members, the gaps between two adjacent substantially horizontal edges of the cover members may serve as openings. The size of the openings 5 is arranged such that the effective diameter of the openings 5 is greater than the distance between the heating surface 1 and the surface of the cover means 2. In case of spaced apart openings, the relation between the effective diameter of each opening 5 and the distance between the heating surface 1 and the cover means 2 can be expressed by:

$d > \sqrt{s \cdot L}$ wherein d is the effective diameter of each opening 5, s is the average distance between the cover means and the heating surface, and L is the horizontal distance between the centers of two adjacent openings 5. The shape of the openings may be rectangular, square, triangular, polygonal, circular, elliptical, oblong or any other shape.

Preferably, the heating surface 1 and the cover means 2 are arranged such that they extend substantially upward or they have at least one portion extending upward. The openings are generally provided at the top side of the cover means 2. However, additional openings may be provided below the top openings 5. The distance M (FIG. 3) between two adjacent openings along a line formed by the intersection of the cover means and a vertical crosswise plane is about 0.5 cm to 20 cm if the flow passage of the vapor is long. The horizontal distance between the ends of two adjacent openings is not greater than 5 times the average distance between the cover member and the heating surface.

The distance between two adjacent spacer members is about 0.2 mm–300 mm, and the height and the width of each spacer member is about 0.05 mm–10 mm and 0.1 mm–10 mm respectively.

Figure 6:
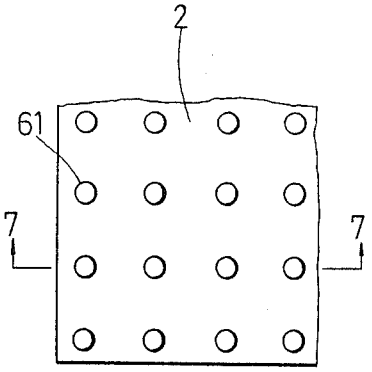
FIGS. 6 to 9 show the cover means and the heating surface of the present invention with integrally formed spacer members in the form of stubby protuberances.
Figure 7:
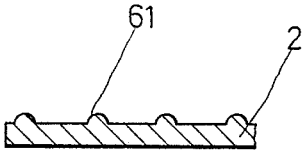
Figure 8:
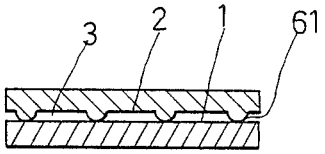
Figure 9:
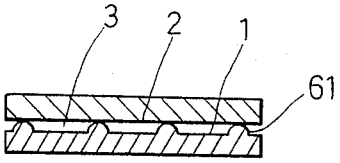

The spacer members 6 may be in various forms. In an embodiment of the invention, the spacer members 6 are illustrated in FIGS. 6, 7 and 8, wherein the spacer members are small stubby protuberances 61 which are formed on the surface of the cover means 2 by casting or welding or by a suitable bonding or securing means. The cover means 2 is spaced apart from the heating surface 1 by making all or some of the ends of the stubby protuberances 61 to contact with or to be in connection with the opposing heating surface 1. Alternatively, the stubby protuberances 61 can be formed on the heating surface 1 instead of the cover means 2, as shown in FIG. 9, to achieve a similar effect.

Figure 10:
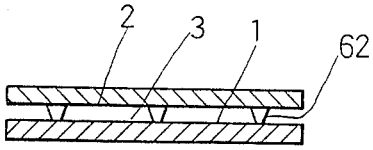
FIG. 10 shows spacer members in the form of stubby props attached to the cover means or the heating surface.

In another embodiment of the invention, the spacer members are a plurality of metallic or non-metallic small stubby props 62 spaced apart from each other and disposed between the heating surface 1 and the cover means 2 as shown in FIG. 10. The stubby props 62 are separate pieces from the cover means and the heating surface and can be secured to the heating surface 1 or the cover means 2 by welding, by adhesive-bonding or other securing methods. All or some of the ends of the stubby props 62 are made to contact with the opposite cover means 2 or the opposite heating surface 1.

The above-described stubby protuberances 61 and stubby props 62 may be of any shape such as dome-shaped, cone-shaped, truncated cone-shaped, ball-shaped, conical, pyramidal, oval, cylindrical, cubic, or any other similar shape.

Figure 11:
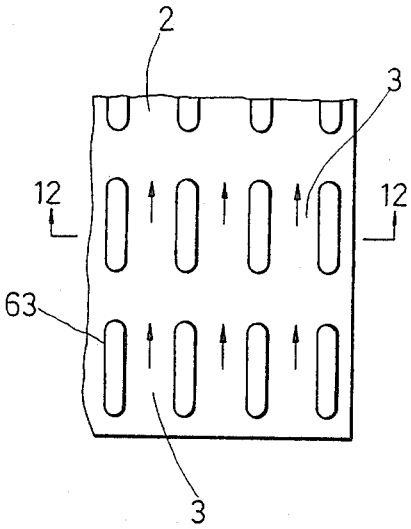
FIGS. 11, 11*a*, 12, 13 and 14 show spacer members in the form of elongated protuberances integrally formed on the cover means or the heating surface.
Figure 11A:
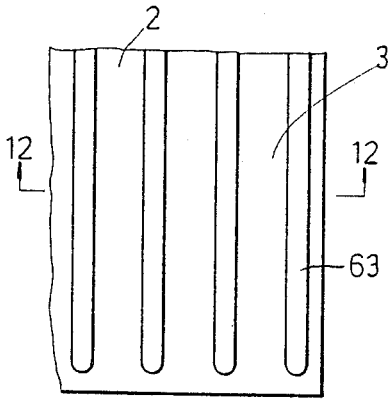
Figure 12:
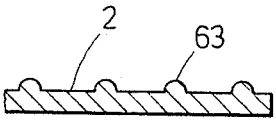
Figure 13:
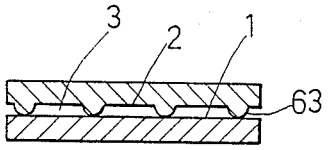
Figure 14:
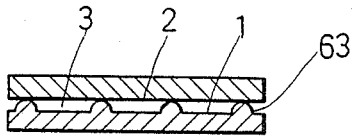

Referring to FIGS. 11, 11*a*, 12 and 13, in another embodiment of the invention, the spacer members are rows of elongated protuberances 63 formed integrally on the surface of the cover means 2. The elongated protuberances 63 may be of any desired length. It can be discrete elongated protuberances, as shown in FIG. 11, or continuous elongated protuberances, as shown in FIG. 11*a*. The cover means 2 is superimposed on the heating surface 1 with all or some of the ends of the spacer members 63 being in contact with the heating surface 1. Alternatively, the elongated protuberances 63 can be formed integrally on the heating surface 1, as shown in FIG. 14 to achieve a similar effect. These elongated protuberances confine a plurality of elongated passages in the space 3 between the heating surface 1 and the cover means 2. The directions of the elongated protuberances 63 are substantially along the lines formed by the intersection of the cover means and vertical crosswise planes so that each vapor passage confined by the elongated protuberances has the greatest possible inclined angle with respect to a horizontal axis to permit vapor to move upward along the heating surface 1 rapidly.

Figure 15:
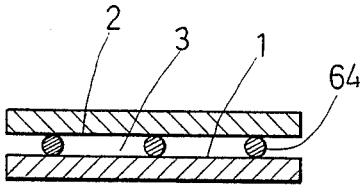
FIGS. 15 and 15*a* show spacer members in the form of discrete and continuous elongated props attached to the cover means or the heating surface.
Figure 15A:
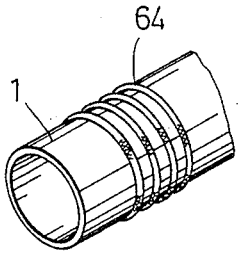

Referring to FIG. 15, elongated props 64 can be used instead of the elongated protuberances 63. It can be discrete elongated props or continuous elongated props. The props 64 which are of separate pieces from the heating surface and the cover means are fixed to one of the heating surface 1 and the cover means 2 by welding, adhesive-bonding, fastening, clamping or other securing means, and the cover means 2 is superimposed on the heating surface 1. All or some of the ends of the props 64 which are not fixed are in contact the opposing heating surface 1 or cover means 2. Alternatively, the cover means 2 can be spaced apart from the heating surface 1 with the props 64 being clamped between the heating surface 1 and the cover means 2. The elongated props 64 may extend continuously on the heating surface or on the cover means which is shaped tubularly. For example, the flexible slender materials such as threads, cords or ropes etc., may be used as elongated props to be wound on the tubular shaped heating surface or on the sleeve-shaped cover means as shown in FIG. 15*a*.

The above described elongated protuberances 63 and elongated props 64 may have a cross-section which is triangular, trapezoidal, rectangular, square, elliptical, circular semicircular, arc-shaped or of any other similar shape.

Figure 16:
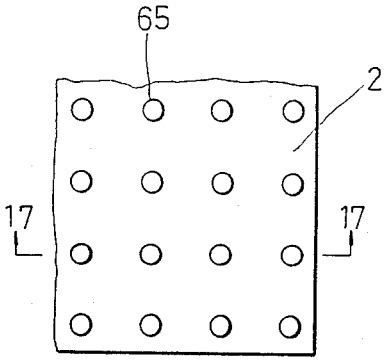
FIGS. 16, 17, 18, 19, 19*a*, 20, 21, 21*a* and 21*b* show spacer members in the form of stubby protuberances, discrete and continuous elongated protuberances formed by a pressing or piercing process on thin plate cover means.
Figure 17:
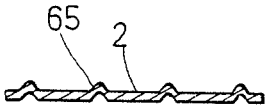
Figure 18:
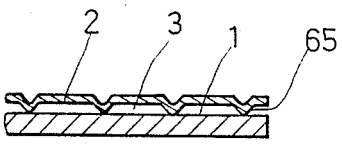

Referring to FIGS. 16, 17 and 18, in still another embodiment of the invention, the spacer members are small, stubby protuberances 65 of an appropriate height, formed on the cover means 2 of a thin plate by casting, embossing, piercing or any other suitable pressing method. The protuberances 65 may be in a dome shape, conical shape, pyramidal shape or any of other shapes, and may or may not have torn or pierced holes. In case of the protuberances 65 with holes, the width or the diameter of the holes is preferably not larger than 1.0 mm. It is not necessary to contact all of the projecting ends of the protuberances with the heating surface. All or some of the projecting ends of the protuberances 65 are made to contact with the heating surface 1 to form the space 3, as shown in FIG. 18.

Figure 19:
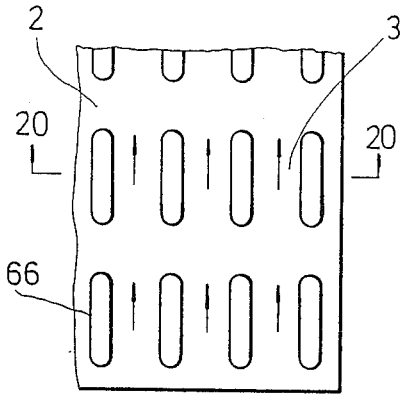
Figure 21:
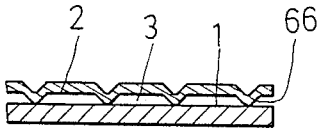
Figure 19A:
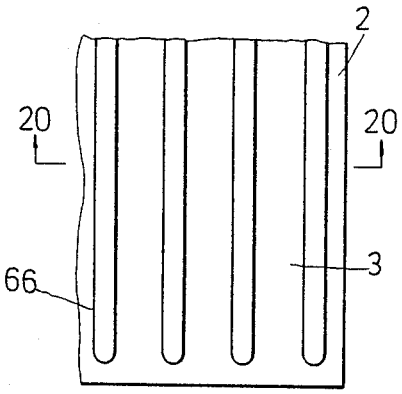
Figure 21A:
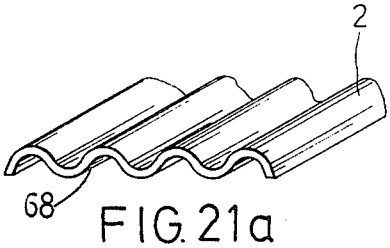
Figure 20:
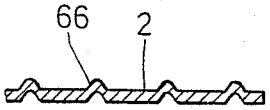
Figure 21B:
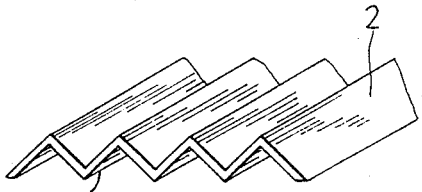

Referring to FIGS. 19, 19*a*, 20 and 21, the cover means 2 in the form of a thin cover plate is formed with elongated protuberances 66 such as by embossing or any other suitable pressing process. The elongated protuberances 66 may be of any desired length. It can be discrete elongated protuberances as shown in FIG. 19, or continuous elongated protuberances as shown in FIG. 19*a*. The elongated protuberances 66 are arranged with appropriate heights. Also, the directions of the elongated protuberances 66 are arranged along the lines formed by the intersection of the cover means and vertical crosswise planes so that the passages confined by the protuberances 66 have the greatest possible inclination relative to a horizontal line to permit vapor to move upward along the heating surface 1 rapidly. The cross-section of the protuberances 66 may be semi-circular, arc-shaped, trapezoidal, rectangular, wavy, zigzag-shaped or of any other similar shapes. The wavy and zigzag-shaped cover means are shown in FIGS. 21*a* and 21b. The elongated protuberances 68 are not limited in length, and may be a continuous elongated protuberance or discrete elongated protuberances.

Figure 22:
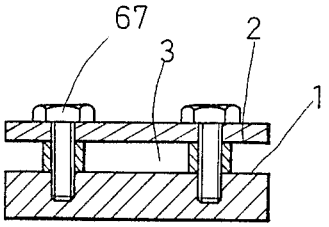
FIG. 22 shows screw members disposed between the cover means and the heating surface to serve as the spacer members.

In still another embodiment of the invention, the spacer members are screw members 67 as shown in FIG. 22, which are attached at intervals to the heating surface 1 and the cover means 2 to keep the cover means 2 fixed to the heating surface 1. Both the surface 1 and the cover means 2 may be plain surfaces or have protuberances on them.

When the screw members are used in combination with any one of the above protuberances, all, some, or none of the ends of the protuberances may be in contact with the surface opposite to the protuberances. The above-mentioned spacer members such as protuberances 61, 63, 65, 66, 68, props 62 and 64 are arranged to have a height of preferably about 0.05 mm to 10 mm, most preferably of about 0.1 mm to 5 mm, and are spaced apart at a distance preferably of about 0.2 mm to 300 mm, most preferably of about 0.5 mm to 50 mm. The above spacer members are preferably disposed on the cover means 2 or the heating surface 1 substantially with equal heights. If the cover means 2 is stiff and thick and the space between the cover means 2 and the heating surface 1 is large, the space between the spcer members can be made larger. On the contrary, if the cover means 2 is flexible and thin and the space between the heating surface 1 and the cover means 2 is small, the space between the spacer members can be made small. The width or diameter of the spacer members is preferably from about 0.1 mm to 10 mm, most preferably from about 0.3 to 3 mm.

The arrangement according to the present invention can be disposed easily on the heating surface of any shape and any position, such as at the inner side of an enclosed container, at the inner side of a pipe or a heating element with a small heating surface or at the outer side of a pipe. For example, the invention can be employed in evaporators of refrigerators or air conditioning equipment.

Figure 23:
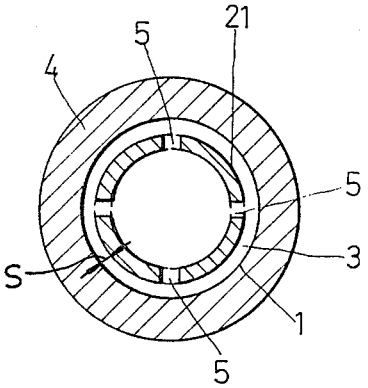
FIGS. 23 and 24 show a horizontal pipe incorporating an arrangement for enhancing heat transfer according to the present invention at its inner side.
Figure 24:
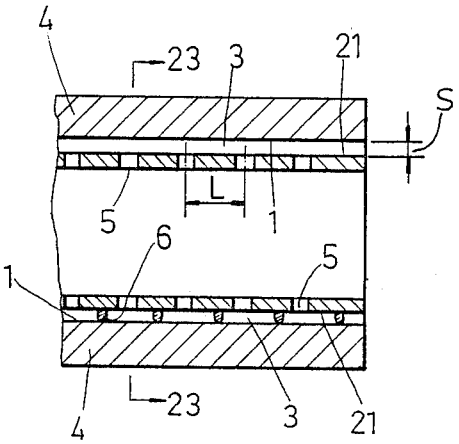

Referring to FIGS. 23 and 24, a heating surface 1 is at the inner side of a pipe 4, and a one-piece tubular cover member 21 which has a diameter smaller than that of the pipe 4 is inserted concentrically in the pipe 4 and spaced apart from the heating surface 1 by means of spacer members 6. The spacer members 6 may be any of those described above and are spaced apart axially and circumferentially. The tubular cover member 21 is provided with vapor release openings 5 at the top and bottom and at two sides of the cover member 21. Preferably, the distance between two adjacent openings along the line formed by the intersection of the cover member 21 and a vertical crosswise plane is about 0.5 cm to 20 cm, and the net horizontal distance between the two adjacent openings 5 at the top side of the cover means 2 are not greater than 5 times the average distance between the heating surface and the cover member. Besides on the horizontal pipe, the arrangement of FIGS. 23 and 24 can also be disposed on an inclined or a vertical pipe. When the liquid placed in the pipe 4 is heated by the heating surface 1 of the pipe 4, vapor bubbles formed at the heating surface 1 depart from the heating surface 1 and rise upward, and finally are released from the space 3 through the openings 5. As the space 3 allows upward movement of the vapor bubbles, an effective agitation of the liquid and enhanced heat transfer result.

Figure 25:
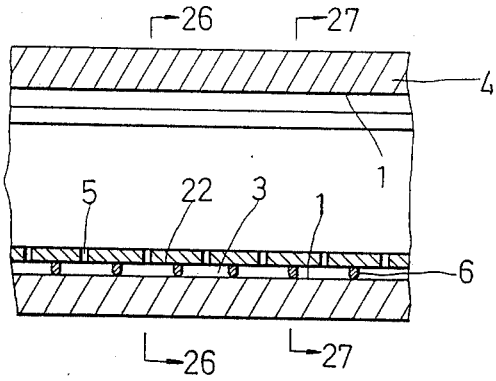
FIGS. 25, 26 and 27 show a horizontal pipe incorporating another arrangement for enhancing heat transfer according to the present invention at its inner side.
Figure 26:
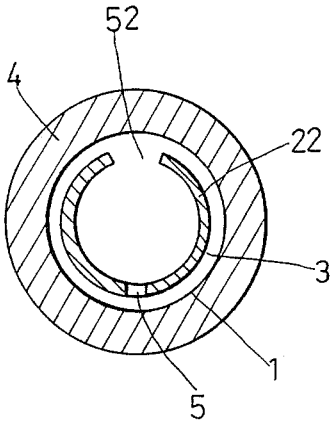
Figure 27:
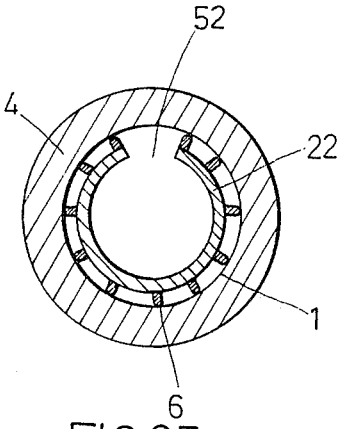

Referring to FIGS. 25, 26 and 27, the arrangement of the invention is disposed at the inner side of the horizontal pipe 4, wherein the heating surface 1 of the pipe 4 is covered with a one-piece curved cover member 22 of arc-shaped cross-section. The longitudinal gap 52 between two top ends of the cover member 22 serve as a continuous opening, while the openings 5 at the bottom of the cover member 22 are spaced apart from each other. Spacer members 6 are spaced apart circumferentially and axially. The longitudinally elongated opening 52 can also facilitate the longitudinal movement of the collected vapor.

Figure 31:
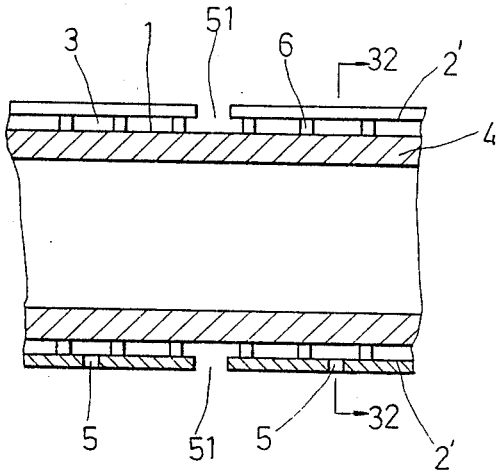
FIGS. 31 and 32 show a horizontal pipe with multiple cover members at the outer side thereof.
Figure 32:
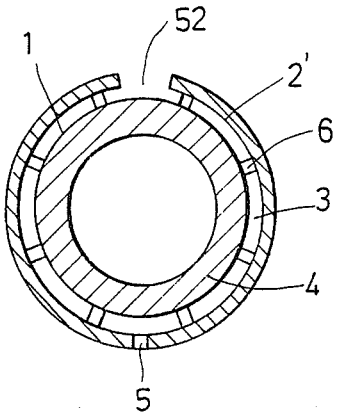

Referring to FIGS. 31 and 32, the arrangement of the invention is disposed at the outer side of a substantially horizontal pipe 4. The heating surface 1 of the pipe 4 is covered with multiple cover members 2'. The spacer members 6 may be any one of the forms described above, and are spaced apart axially and circumferentially. The longitudinal gap 52 on the top of the pipe 4 serves as an opening. Instead of being used on the horizontal pipe, the arrangement of FIGS. 31 and 32 can also be used on an inclined pipe. Besides the gap 52 on the top of the pipe 4, the circumferential gaps 51 between two adjacent edges of the cover members 2' may also serve as openings when the pipe 4 is inclined. If the pipe 4 is long, multiple sections of the cover members may be disposed longitudinally as shown in FIG. 31 for the purpose of easy installation.

Figure 33:
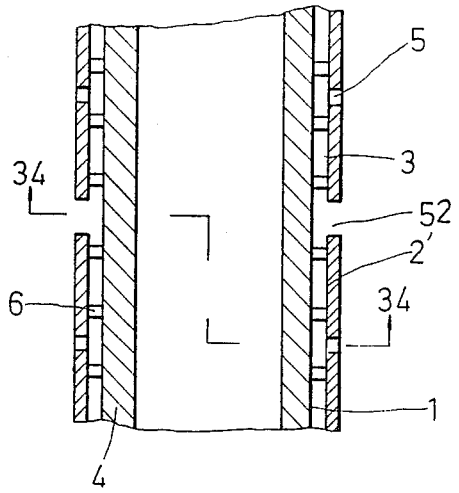
FIG. 33 and 34 show a vertical pipe with multiple cover members at the outer side thereof.
Figure 34:
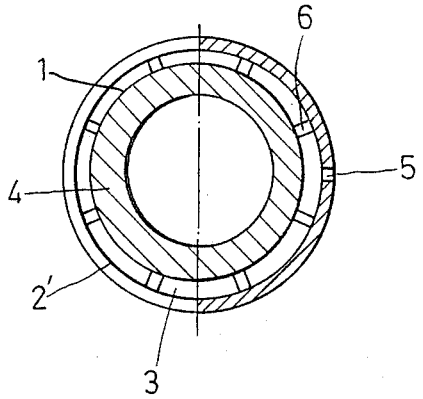

Referring to FIGS. 33 and 34, the arrangement of the invention is disposed at the outer side of a substantially vertical pipe 4. The heating surface 1 of the pipe 4 is covered with multiple cover members 2'. The spacer members 6 may be any one of the forms described above, and are spaced apart axially and circumferentially. The horizontal gap 52 between two adjacent edges of the cover members 2' serves as openings. Instead of being used on the vertical pipe, the arrangement of FIGS. 33 and 34 can also be used on an inclined pipe.

Figure 28:
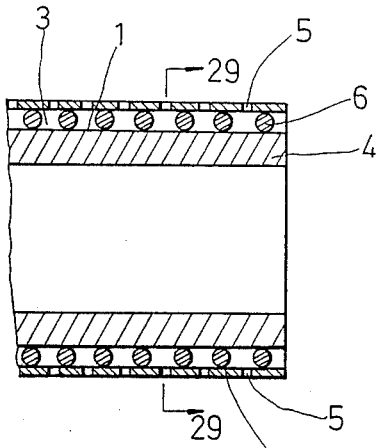
FIGS. 28, and 29 show a horizontal pipe incorporating another arrangement for enhancing heat transfer according to the present invention in which cords are used as spacer members on the outer side of the pipe.
Figure 29:
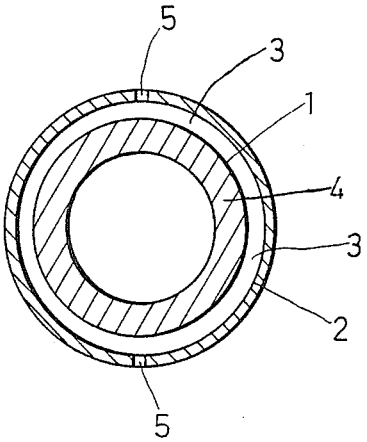

FIGS. 28 and 29 show an arrangement of the invention disposed at the outer side of a pipe 4 substantially lying horizontally. The spacer members 6 are metallic or non-metalic cords or ropes, monowires, or monorods etc., and are wound on the pipe 4 spirally or annularly. The cover means 2 are provided with top and bottom openings 5 for the fluid to flow therethrough.

Figure 30:
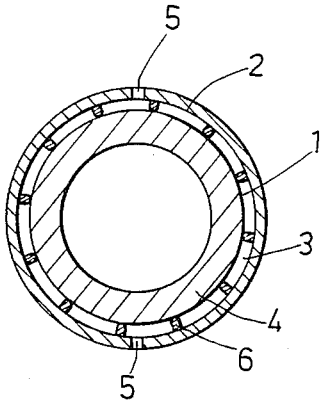
FIG. 30 shows still another arrangement at the outer side of a pipe in which stubby protuberances are used as spacer members.

FIGS. 30 shows a horizontal pipe 4 with a cover means 2 spaced apart from its outer perihery by means of spacer members 6 which are in the form of protuberances 61 and 65. The protuberances 61 or 65 are spaced axially and circumferentially. The arrangement can be disposed at a horizontal, inclined or vertical pipes.

Tests are conducted to investigate the heat transfer efficiency of the arrangement according to the present invention, and to compare the results of the conventional heat transfer arragements. The following is an expression for comparison of heat transfer coefficients of two heat transfer surfaces, which is derived in the condition that the heat fluxes across said two heat transfer surfaces are identical:

$$\frac{h2}{h1} = \frac{T1 - 100}{T2 - 100}$$

wherein h1 and h2 represent heat transfer coefficients of Tests 1 and 2, and T1 and T2 represent maximum temperatures of the heating surfaces of Tests 1 and 2 respectively.

TEST 1

A closed horizontal copper pipe with an outside diameter of 38 mm, a length of 200 mm, and a wall thickness of 7 mm, is placed in a water container under normal pressure, the water is boiled by an electric heating device, and then the temperature of the surface of the pipe is measured by a Chromel Alumel Thermocouple and recorded every minute. The Test is stopped 5 minutes after the temperature becomes constant.

TEST 2

A horizontal pipe similar to that used in Test 1 is provided with a cover means of the present invention which is made of copper foil having embossed dome-shaped protuberance thereon. The thickness of the copper foil is 4/1000 inches, and the height and the diameter of each protuberance is about 1 mm and 4 mm respectively. The center to center distance of the protuberances is about 10 mm. Openings 5 of about 2 mm width are provided at the top and bottom of the copper foil. The configuration of the heat transfer surface is as that shown in FIG. 30. The test procedure is the same as that described above.

Test results of Tests 1 and 2 are shown in Table 1.

TABLE 1

| Heat flux $KW/M^2$ | 45 | 30 | 15 | 7.5 |
|---|---|---|---|---|
| T1 (Test 1) °C. | 110.5 | 108.5 | 106.0 | 104.5 |
| T2 (Test 2) °C. | 105.5 | 104.0 | 102.5 | 101.5 |
| h2/h1 | 1.91 | 2.13 | 2.40 | 3.00 |

wherein h2 is the heat transfer coefficient of the present invention and h1 is the heat transfer coefficient of the conventional heat transfer surface.

TEST 3

A horizontal pipe similar to that used in Test 1 is provided with a heat transfer surface, wherein threads of 1.2 mm diameter braided from plastic filaments are wound at an interval of 2 mm distance which is similar to the arrangement dislosed in U.S. Pat. No. 4,074,753. The test procedure is the same as in Test 1.

TEST 4

The pipe used in Test 3 is further covered with two sheets of copper foil having a thickness of 4/1000 inches which are tied to the pipe by a cord. The sheets of foil are spaced apart at the top and bottom of the pipe to have longitudinal gaps of 2 mm to serve as openings 5. The configuration of the arrangement is as that shown in FIGS. 28 and 29. The test procedure is the same as in test 1.

The test results of Test 1, 3, and 4 are shown in Table 2:

TABLE 2

| Heat flux ($kw/m^2$) | 45 | 30 | 15 | 7.5 |
|---|---|---|---|---|
| T1 ( Test 1) °C. | 110.5 | 108.5 | 106.0 | 104.5 |
| T3 (Test 3) °C. | 106.5 | 104.5 | 103.0 | 102.0 |
| T4 (Test 4) °C. | 105.0 | 103.5 | 102.0 | 101.3 |
| h3/h1 | 1.62 | 1.89 | 2.00 | 2.25 |
| h4/h1 | 2.10 | 2.43 | 3.00 | 3.46 |

where T1, T3 and T4 are maximum temperatures of the heat transfer surface of Tests 1, 3 and 4, and h1, h3 and h4 are heat transfer coefficients of Tests 1, 3 and 4 respectively.

From Tables 1 and 2, it can be noted that the heat exchange arrangement according to the present invention is more efficient than the other heat transfer surfaces. Also, it can be appreciated that the present invention can be incorporated not only into the conventional plain heating surface but also into any one of those improved heating surfaces with enhanced nucleate sites disclosed in the afore-mentioned prior references.

With the invention thus explained, it is apparent that various modifications and variations can be made without departing from the scope of the invention. It is therefore intended that the invention be limited only as indicated in the appended claims.

What I claim is:

1. An apparatus for enhancing the transfer of heat in nucleate boiling comprising:

a heating wall having a heating surface;

cover means which is of a single layer and separate from said heating wall, being disposed over and spaced apart from said heating surface for diverting vapor to flow along said heating surface, said cover means having opening means to permit vapor to flow out therethrough, said opening means having an effective diameter greater than an average distance between said heating surface and said cover means; and spacer means disposed between said heating surface and said cover means.

2. An apparatus as claimed in claim 1, wherein said opening means includes a plurality of openings which are spaced apart from each other, and the relation between the effective diameter of each of said openings and the distance between the cover means and the heating surface is expressed by:

$$d > \sqrt{s \cdot L}$$

wherein d is the effective diameter of each of said opening, s is the distance between said cover means and said heating surface, and L is a horizontal distance between two adjacent said openings.

3. A heat transfer arrangement as claimed in claim 2, wherein said openings are disposed at an interval less than 5 times an average distance between said cover means and said heating surface.

4. An apparatus as claimed in claim 2, wherein both said heating wall and said cover means have at least one portion extending upward, and said openings are disposed at a top side of said cover means.

5. An apparatus as claimed in claim 4, wherein additional said openings are provided in said cover means below said top openings, the distance between two adjacent said openings along a line formed by the intersection of said cover means and a vertical plane perpendicular to said cover means is about 0.5 cm to 20 cm.

6. An apparatus as claimed in claim 1, wherein said cover means is spaced apart from said heating surface at an average distance of about 0.05 mm–10 mm.

7. An apparatus arrangement as claimed in claim 1, wherein said spacer means includes stubby pieces which are spaced apart from each other.

8. An apparatus as claimed in claim 7, wherein said stubby pieces are one piece with said heating surface and in contact with said cover means.

9. An apparatus as claimed in claim 7, wherein said stubby pieces are one piece with said cover means and in contact with said heating surface.

10. An apparatus as claimed in claim 7, wherein said stubby pieces are separate pieces from said cover means and said heating surface.

11. An apparatus as claimed in claim 10, wherein said stubby pieces are screw members attached to said cover means and said heating surface.

12. An apparatus as claimed in claim 7, wherein the interval between two adjacent said stubby pieces is about 0.2 mm–300 mm.

13. An apparatus as claimed in claim 12, wherein the height and the width of each of said stubby pieces is about 0.05 mm to 10 mm and 0.1 mm to 10 mm respectively.

14. An apparatus as claimed in claim 1, wherein said spacer means includes a plurality of spacer members which are formed integrally on said cover means and extend towards opposing said heating surface or said cover means, some of said spacer members being in contact with said opposing heating surface or said cover means.

15. An apparatus as claimed in claim 1, wherein said spacer means includes discrete elongated pieces which are spaced apart from each other.

16. An apparatus as claimed in claim 15, wherein said heating wall has a portion extending upward, and said elongated pieces extend in an upward direction along said heating surface.

17. An apparatus as claimed in claim 15, said elongated pieces are one piece with said cover means and in contact with said heating surface.

18. An apparatus as claimed in claim 15, wherein said elongated pieces are one piece with said heating surface and in contact with said cover means.

19. An apparatus as claimed in claim 15, wherein said elongated pieces are separate pieces from said heating surface and said cover means.

20. An apparatus as claimed in claim 15, wherein the interval between said elongated pieces is about 0.2 mm–300 mm, and the height and the width of each of said elongated pieces is about 0.05 mm–10 mm and 0.1 mm–10 mm respectively.

21. An apparatus as claimed in claim 1, wherein said heating wall has at least one portion extending upward, and said spacer means includes continuous elongated pieces extending upwardly along said upward portion.

22. An apparatus as claimed in claim 21, wherein said heating wall is a tubular wall and said spacer means includes at least one continuous flexible elongated member which is wound around said heating wall.

23. An apparatus as claimed in claim 1, wherein said cover means is a material selected from a metallic impervious material, a non-metallic impervious material, a metallic pervious material and a non-metallic pervious material having a maximum pore size of about 1.0 mm.

24. An apparatus as claimed in claim 1, wherein said cover means includes a single piece cover member.

25. An apparatus as claimed in claim 1, wherein said cover means includes a plurality of cover members.

26. An apparatus as claimed in claim 25, wherein the width of each of said cover members is greater than 4 mm.

27. An apparatus as claimed in claim 25, wherein each of said cover members is spaced apart from an adjacent said cover member to form a gap therebetween, said gap serving as said opening means.

28. An apparatus as claimed in claim 25, wherein the space between two adjacent said cover members is greater than the average distance between said heating surface and said cover members.

29. An apparatus as claimed in claim 1, wherein all of the ends of said spacer members are in contact with their opposing surface.

* * * * *